US006642718B2

(12) United States Patent
Brushwood

(10) Patent No.: US 6,642,718 B2
(45) Date of Patent: Nov. 4, 2003

(54) IGNITION SYSTEM MONITORING ASSEMBLY

(75) Inventor: John Samuel Brushwood, Oviedo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 48 days.

(21) Appl. No.: 09/963,281

(22) Filed: Sep. 26, 2001

(65) Prior Publication Data

US 2003/0057951 A1 Mar. 27, 2003

(51) Int. Cl.[7] ..... F02P 17/00
(52) U.S. Cl. ..... 324/393; 324/380
(58) Field of Search ..... 23/257; 313/11.5; 324/380, 390, 400, 393; 356/316

(56) References Cited

U.S. PATENT DOCUMENTS 4,514,656 A * 4/1985 Damson et al. ..... 313/11.5
4,919,099 A * 4/1990 Extance et al. ..... 123/425
5,237,969 A * 8/1993 Sakin ..... 123/143 B
5,572,135 A 11/1996 Owens et al.
5,675,257 A 10/1997 Frus
5,969,617 A 10/1999 Garthe
5,978,525 A * 11/1999 Shu et al. ..... 385/12
6,094,990 A 8/2000 Lykowski
6,204,594 B1 3/2001 Ingham
2002/0093652 A1 * 7/2002 Powell ..... 356/316

* cited by examiner

*Primary Examiner*—Jay Patidar
*Assistant Examiner*—Walter Benson

(57) ABSTRACT

An ignition system monitoring assembly for use in a combustion engine is disclosed. The assembly includes an igniter having at least one positioning guide with at least one transmittal member being maintained in a preferred orientation by one of the positioning guides. The transmittal member is in optical communication with a corresponding target region, and optical information about the target region is conveyed to the reception member via the transmittal member. The device allows real-time observation of optical characteristics of the target region. The target region may be the spark gap between the igniter electrodes, or other predetermined locations in optical communication with the transmittal member. The reception member may send an output signal to a processing member which, in turn, may produce a response to the output signal.

9 Claims, 2 Drawing Sheets

IGNITION SYSTEM MONITORING ASSEMBLY

STATEMENT OF GOVERNMENT INTEREST

This invention was made with United States Government support under contract number DE-FC21-90MC25140 awarded by the Department of Energy. The United States Government has certain rights under this invention.

FIELD OF THE INVENTION

This invention relates generally to the field of internal combustion igniters and, more particularly, to an ignition system monitoring assembly for industrial gas turbine engines.

BACKGROUND OF THE INVENTION

Power for many applications may be generated by harnessing energy from the products of combustion. One type of machine that harnesses this energy is the combustion engine. Industrial gas turbine engines, internal combustion engines, and jet aircraft engines are all examples of this type of machinery. Each of these machines burns some sort of fuel and converts the chemical energy stored in the fuel into mechanical energy to create electricity, produce thrust, or otherwise do work. To this end, combustion engines include components that initiate and sustain the burning of fuels provided by an associated fuel supply.

In the industrial gas turbine environment, igniters are used to provide an electrically-charged arc that causes fuel introduced by injection nozzles to combust, beginning the power generation process. Faulty igniters will impede engine performance, and can actually prevent an entire engine from starting. In single-igniter systems, a faulty igniter may be relatively-easy to diagnose, but in larger engines, with multiple igniters, this analysis can be quite difficult.

Since industrial gas turbine equipment is often used to provide electricity to municipalities, failure of this equipment can be disastrous, resulting in widespread power outages and a multitude of downstream effects. It is important, therefore, to ensure the proper operation of igniters and the other components associated with combustion engine ignition systems. To this end, various monitoring systems have been developed.

Several devices, including solid state analysis circuits connected to ignition equipment, igniters with integrated pressure sensors, and even ionization detection components help monitor various aspects of ignition systems. However, while these devices allow ignition and combustion system analysis, with varying degrees of success, they have shortcomings. Many of the systems are quite complex and can add considerably to the expense of a given engine. Others arrangements are machine-specific and must be installed during initial engine assembly, eliminating their applicability as a choice for retrofit equipment. Others systems are simply inaccurate, erroneously indicating not only combustion initiating arcs, but also voltage drops that have simply been caused by short circuits within the igniter.

Accordingly, a need exists in the art for a monitoring assembly that allows positive optical confirmation of igniter arc production. The assembly should accommodate a variety of designs and be capable of use within previously-installed equipment without extensive modification of existing components. Additionally, the assembly should allow real-time monitoring of several preselected locations simultaneously. The assembly should additionally allow collection of an array of information from one or several locations for archival and/or engine control purposes.

SUMMARY OF THE INVENTION

The instant invention is an ignition system monitoring assembly that allows positive indication of spark production by a combustion engine igniter. The assembly includes an igniter adapted to produce an arc sufficient to begin combustion of supplied fuel. A positioning guide associated with the igniter will hold and maintain a signal-transferring transmittal member with respect to the igniter. A reception member is optically linked with an igniter spark gap target region via the transmittal member and thus receives optical information from the transmittal member. More than one transmittal member may be used, and other locations may be monitored. The reception member may allow unaided observation of the target region or other locations and may produce electronic or other output based upon the signal transferred by the transmittal member. The monitoring assembly may also include a processing device operatively associated with the reception member for signal recording or manipulation; the processing device may also be linked to engine control equipment to facilitate real-time engine management.

Accordingly, it is an object of the present invention to provide a monitoring assembly that allows positive visual confirmation of igniter arc production. It is also an object of the present invention to provide a monitoring assembly that accommodates a variety of designs and can be used within previously-installed equipment without extensive modification of existing components. It is still a further object of the present invention to provide a monitoring assembly that allows real-time monitoring of several preselected locations simultaneously. An additional object of the present invention is to provide a monitoring assembly that allows collection of information from one or several locations for archival and/or engine control purposes.

Other objects and advantages of this invention will become apparent from the following description taken in conjunction with the accompanying drawings wherein are set forth, by way of illustration and example, certain embodiments of this invention. The drawings constitute part of this specification and include exemplary embodiments of the present invention and illustrate various objects and features thereof.

DETAILED DESCRIPTION OF THE INVENTION

Figure 1:
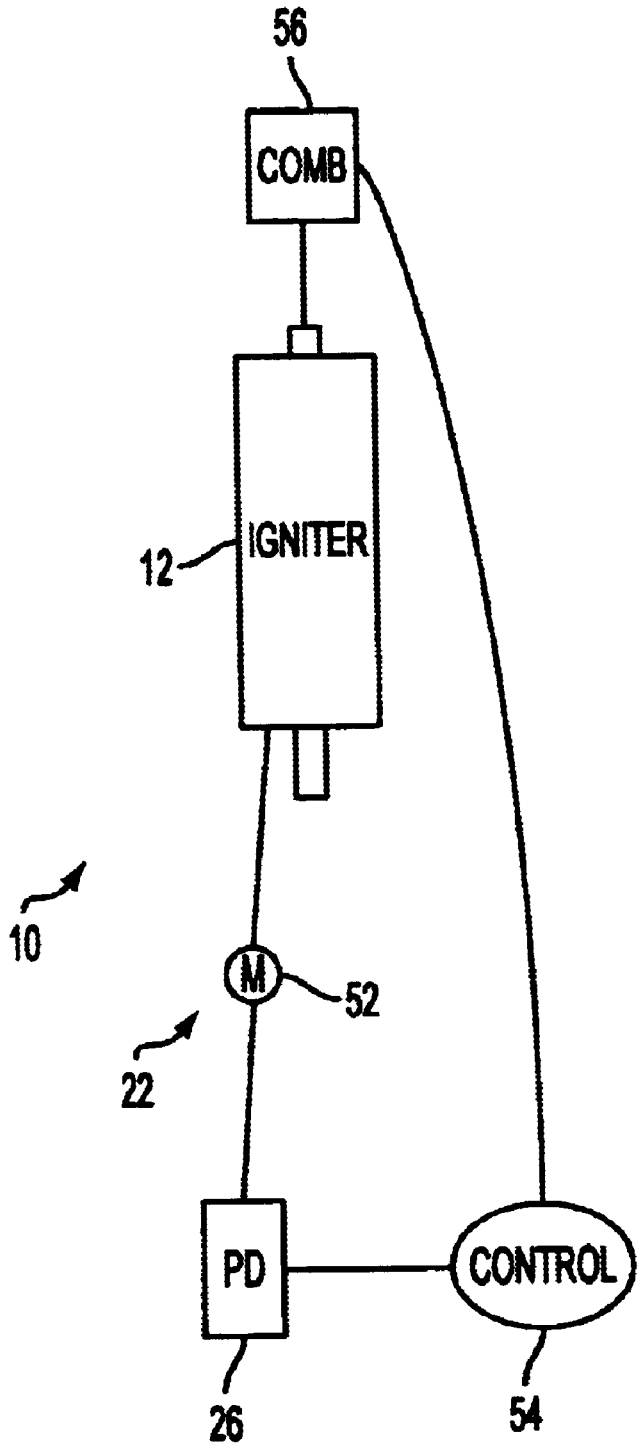
FIG. 1 is schematic view of the ignition system monitoring assembly of the present invention.

Now with general reference to the Figures, an ignition system monitoring assembly 10 according to the present invention will be described. By way of overview, the monitoring assembly 10 includes an igniter 12 adapted for use with a combustor 56 to ignite fuel supplied thereto. As seen with particular reference to FIG. 2, the igniter 12 includes electrodes 14,16 that facilitate the creation of a fuel-igniting arc or spark, and a positioning guide 18 that holds at least one transmittal member 20 in a preferred orientation with respect to the igniter. As will be described more fully below, the transmittal member 20 optically links the first end 28 of the igniter 12 with at least one reception member 22. Real-time optical output from the first or firing end 28 of the igniter is conveyed to the reception member 22 by the transmittal member 20. The optical output may be stored or otherwise manipulated by a processing device or component 26 operatively linked with the reception member 22. The reception member 22 and the processing device 26 may be located remote from the igniter 12. The ignition system monitoring assembly 10 of the present invention advantageously provides visual feedback about the existence and quality of spark, thereby allowing real-time spark verification, as well as on-going flame verification and qualification. Multiple transmittal and reception members 20,22 may be positioned and used as desired to monitor various aspects of the environment associated with the igniter 12. As seen in FIG. 1, the reception member 22 may also be linked to a processing device 26 that responds to output from the reception member With continued reference to FIG. 2, and with additional reference to FIG. 1, the igniter 12 of the ignition system monitoring assembly 10 of the present invention will now be described. The igniter 12 is essentially an elongated device having a body 32 characterized by first end 28 and an opposite second end 30. The igniter first end 28 includes a first, or firing, electrode 14 and a second, or ground, electrode 16 that are spaced apart to define a spark gap 34 therebetween. The first and second electrodes 14,16 are electrically insulated from each other, and during operation, a source of electricity (not shown) selectively imparts the first electrode 14 with voltage sufficient to produce an arc between the first and second electrodes. The electrodes 14,16 are shaped and positioned such that arcs produced across the electrodes occur within a predefined target region 36. In one preferred embodiment, the target region 36 is within the spark gap 34. It is noted, however, that the target region 36 may be remote from the spark gap 34 while still being in optical communication therewith.

Figure 2:
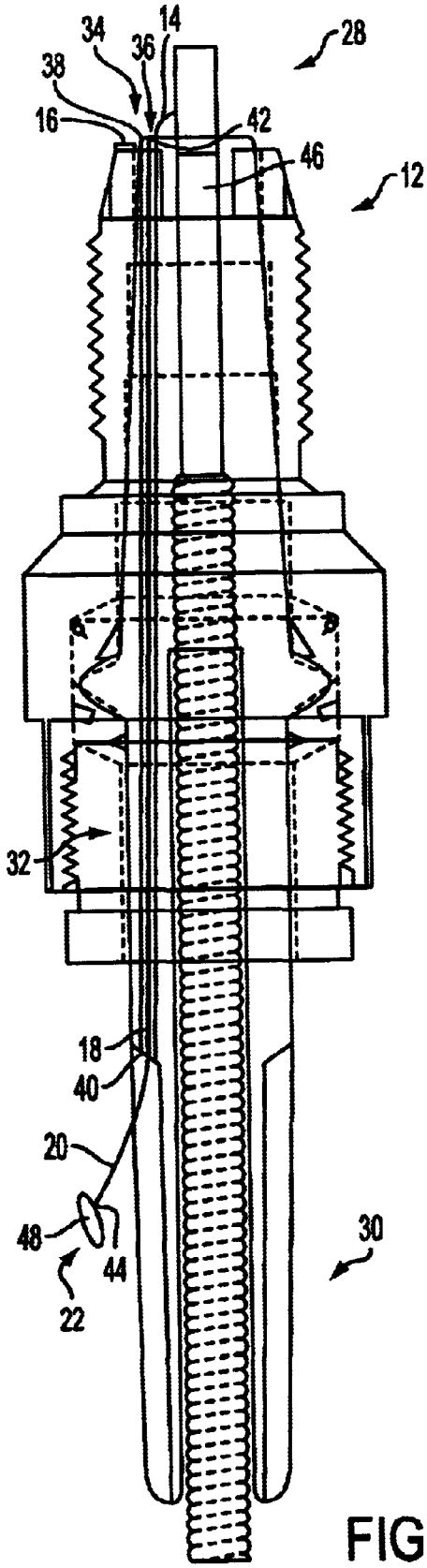
FIG. 2 is a partial plan view of the monitoring assembly shown in FIG. 1.

In a preferred embodiment, shown in FIG. 2, the igniter body 32 includes a positioning guide 18 having a first face 38, which is oriented toward the above-mentioned target region 36, and a second face 40. The positioning guide 18 orients a transmittal member 20 disposed therein, preferably placing a first end 42 of the transmittal member 20 in optical communication with the target region 36. The transmittal member 20 is preferably a fiber optic cable, or similarly-functioning waveguide element, through which optical output from the target region 36 will be transferred. With this arrangement, an image of spark existence within the target region 36 will be transferred from the member first end 42 to a member second end 44 spaced apart therefrom. In one embodiment, the transmittal member first end 42 is substantially terminated within the positioning guide first face 38, and the transmittal member second end 44 extends beyond the positioning guide second face 40. However, the transmittal member ends 42,44 may be fixed at different locations, both within and beyond the positioning guide faces 40,42, as needed. As a result, the transmittal member 20 may monitor, in addition to the spark gap 34, a variety of key regions indicative of engine performance, including an engine combustion region 56, or other similar areas in optical communication with the first end 42 of the transmittal member 20. It is noted that although the transmittal member first end 42 is shown substantially facing the igniter first end 28, the transmittal member need not be oriented in that manner. The first end 42 of the transmittal member 20 may be oriented radially outward from the center cooling channel 46, along the center cooling channel, or other orientations as needed.

Although the positioning guide 18 is shown disposed within the igniter body 32, the positioning guide may also be aligned with a central cooling channel 46. It is also noted that the positioning guide need not be elongated and may include one or more holder elements (not shown) attached to the igniter 12.

The transmittal member 20 is preferably formed from a material having high heat tolerance, such as sapphire or other similar optically-transmittive materials. However, other optically-transductive materials may be used, and the transmittal member first end 42 may be shielded by a protective lens or other similar element (not shown) if desired. It should also be noted that the transmittal member 20 may include an optical shield coating (not shown) to prevent signal losses.

It is also noted that more than one positioning guide 18 may be used to accommodate several transmittal members 20, if needed. If more than one transmittal member 20 is used, the monitoring assembly 10 of the present invention can provide information about several aspects of the environment surrounding the assembly simultaneously. For example, positioning guides 18 may be oriented to direct respective first ends 42 of two transmittal members 20 at the above mentioned target region 36 and a combustion region 56 operatively associated with the igniter 12. As a result, the present invention 10 can advantageously provide real-time optical feedback about a single location, or an array of complementary signals that can be used to assess engine performance criteria, including, but not limited to, flame stability, combustion efficiency, and heat rate.

With continued reference to FIG. 2, the present invention 10 includes a reception member 22 adapted to accept the signal carried by the transmittal member 20. The reception member 22 is in optical communication with the transmittal member second end 44. The reception member 22 may be attached to the second end 44, or may be disposed within the positioning guide second face 40, depending upon the relative orientation of the positioning guide 18 and the reception member. In one embodiment, the reception member 22 includes a lens 48 adapted to permit direct observation of the signal transferred from the transmittal member first end 42 to the transmittal member second end 44. This arrangement allows unassisted monitoring of a selected location, such as a spark gap target region 36 or selected combustor 56. In another embodiment, and shown in FIG. 1, the reception member 22 includes a spectrometer (not shown), a photodiode 52, or a similar light-sensitive electronic device, to produce a signal which may be displayed, recorded, amplified, or otherwise manipulated by a processing device 26 operatively associated with the reception member. A filtering element (not shown) may optionally be used to modify the signal reaching the reception member 22. This arrangement allows real-time observation of a selected location combined with the option of further, signal-based reactions. For example, the processing device 26 may, in turn, be operatively associated with one or more engine control devices 54 arranged to react to output provided by the processing device to interact with various aspects of the engine or combustor 56 associated with the monitored ignition system.

What is claimed is:

1. A spark gap monitoring assembly for use in a combustion engine comprising:

an igniter having a first electrode and a second electrode, said second electrode being spaced apart form said first electrode by a spark gap;

at least one positioning guide associated with said igniter;

at least one transmittal member having a first portion and a second portion in optical communication therewith, said transmittal member being maintained in a preferred orientation by at least one of said at least one positioning guides, said preferred orientation placing said transmittal member first portion in optical communication with a spark gap; and a reception member in optical communication with said transmittal member second portion, said reception member thereby being in optical communication with said spark gap via said transmittal member, whereby said reception member is in optical communication with said spark gap, thereby permitting real-time observation of the existence of a spark within said spark gap.

2. The monitoring assembly of claim 1, wherein said transmittal member is an fiber optic member.

3. The monitoring assembly of claim 2, wherein said transmittal member includes sapphire.

4. The monitoring assembly of claim 1, wherein said reception member is a lens.

5. The monitoring assembly of claim 1, wherein said reception member is a light-sensitive member adapted to create an output signal in response to input from said transmittal member.

6. The monitoring assembly of claim 1, wherein said light-sensitive member is a photodiode.

7. The monitoring assembly of claim 6, further including:

a processing device adapted to produce a response based upon said output signal.

8. The monitoring assembly of claim 7, wherein said response includes producing a recording indicative of said output signal.

9. The monitoring assembly of claim 7, wherein said response includes directing at least one element to interact with a component operatively associated with said igniter.

* * * * *